United States Patent [19]

Castro et al.

[11] Patent Number: 4,755,104

[45] Date of Patent: Jul. 5, 1988

[54] STATOR VANE LINKAGE

[75] Inventors: Joaquin H. Castro, West Palm Beach, Fla.; Robert S. Thompson, Brighton, Mich.

[73] Assignee: United Technologies Corporation, Hartford, Conn.

[21] Appl. No.: 857,203

[22] Filed: Apr. 29, 1986

[51] Int. Cl.[4] ..... F04D 29/46

[52] U.S. Cl. ..... 415/136; 415/150; 415/160; 384/206

[58] Field of Search ..... 415/149 R, 150, 151, 415/159, 160, 134, 136, 144, 145; 60/226.1; 384/206, 192

[56] References Cited

U.S. PATENT DOCUMENTS

| | | | |
|---|---|---|---|
| 1,685,751 | 9/1928 | Pfau | 384/206 |
| 2,936,999 | 5/1960 | Coar et al. | 415/134 |
| 3,115,375 | 12/1963 | Haller | 384/206 |
| 3,314,595 | 4/1967 | Burge et al. | 415/160 |
| 3,367,628 | 2/1968 | Fitton | 415/160 X |
| 3,392,909 | 7/1968 | Turner | 60/226.1 X |
| 3,487,992 | 1/1970 | Pineda | 415/149 R |

FOREIGN PATENT DOCUMENTS

| | | | |
|---|---|---|---|
| 1161244 | 8/1969 | United Kingdom | 384/206 |
| 2038421 | 7/1980 | United Kingdom | 60/226.1 |

*Primary Examiner*—Robert E. Garrett
*Assistant Examiner*—Joseph M. Pitko
*Attorney, Agent, or Firm*—Troxell K. Snyder

[57] ABSTRACT

A linkage (36) is provided for manipulating an internal component (32) of a turbofan gas turbine engine (10) in response to an externally mounted actuator (50). The linkage includes a radial torque shaft (38) supported between two spherical bearings (40, 42). The shaft (38) is slidable within the radially outer bearing (42) for accommodating relative radial movement in addition to relative axial and circumferential movement between the inner compressor case (26) and the outer fan duct (28).

2 Claims, 3 Drawing Sheets

FIG. 1
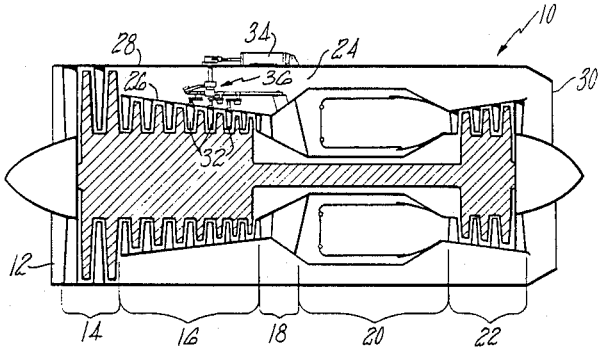
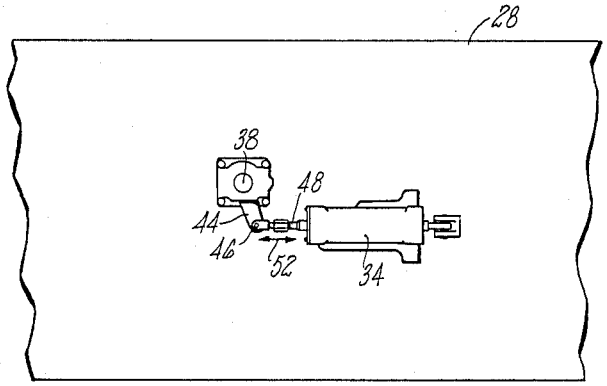
FIG. 4

STATOR VANE LINKAGE

The Government has rights in this invention pursuant to Contract No. F33657-82-C-0122.

FIELD OF THE INVENTION

The present invention relates to a mechanical linkage, and more particularly, to a mechanical linkage for use in a gas turbine engine.

BACKGROUND

Axial flow turbofan gas turbine engines are well known and widely used in the air transport industry. Simply put, an axial turbofan engine differs from an axial turbojet engine in that a portion of the air compressed by the beginning compressor stages, often termed the "fan section", is bypassed coaxially around the inner gas generator or core. This bypass fan air flows for at least some distance in an annular passage created between the gas generator casing and an outer, coaxial fan duct.

In modern axial flow turbofan engines, it is commonly desirable to effect certain mechanical adjustments to various engine structures or components during operation. Such structures include the radially oriented compressor stator vanes, disposed in the compressor section of the gas generator in one or more axially spaced apart sets termed "stages". For reasons of engine operability, reliability, and power output, it is occasionally desirable to simultaneously alter the angle of attack of the generally axially flowing airstream encountering an individual set of stator vanes. Such adjustment is typically carried out by furnishing each individual vane with a mount rotatable about a radially oriented axis, linking each blade of an individual stage together by a plurality of corresponding vane arms extending perpendicular to each axis of rotation for each blade, each arm further being joined at the end thereof to a unison ring encircling the generally cylindrical compressor case and causing equal radial rotation in each linked stator vane in response to relative circumferential displacement between the unison ring and the compressor case.

Such unison ring-variable stator vane arrangements are well known in the gas turbine engine art, requiring only the addition of a selectively drivable actuator and connecting linkage to the above described system to result in an operable system. Certain of these systems known in the prior art use an actuator and driving linkage secured to the compressor casing and disposed wholly within the annular flow passage formed in conjunction with the fan duct. Certain other turbofan engine arrangements, either of small size or having a reduced percentage of the total incoming air bypassed into the passage, have insufficient volume to allow positioning of an actuator and a linkage between the compresor casing and the fan duct without undesirably disrupting airflow therein or hampering field maintenance personnel.

In such engines having insufficient clearance for installing an actuator between the compressor case and surrounding fan duct, it is commonplace to mount the actuator on the exterior of the fan duct and to connect the actuator to the unison ring or other internal driven structure by a mechanical linkage. In addition to manipulating the internal engine structure in response to the externally mounted actuator, such linkages must also accommodate differential or relative movement which frequently occurs between the fan duct and compressor case. Such relative movement, caused by thermal transients, engine loading, externally induced forces, etc. may occur in the axial, circumferential, or radial direction either individually or in combination.

Prior art methods of accommodating this relative movement while still linking the external actuator and internal structure have included the use of corresponding, slidably engaged, splined shaft members disposed between the internal structure and the external actuator. Such slidably engaged structures with their several components have proved less satisfactory in those applications wherein it is desirable to manipulate the internal engine structure to a high degree of accuracy. Such multi-component structures have tended to wear at the sliding interfaces, resulting in a linkage backlash or hysteresis which can degrade the positional accuracy of the internal structure. Such accuracy is particularly important when positioning stator vanes in order to optimize compressor performance and operational reliability.

SUMMARY OF THE INVENTION

In accordance with the present invention, a low-backlash linkage is provided for adjusting the stator vanes in an axial flow, turbofan engine having one or more unison rings disposed within the bypass fan airflow annulus and having a drive actuator located exterior to the fan duct. The provided linkage includes a generally radially oriented torque shaft supported by a pair of spherical bearings which are each secured respectively to the compressor case and the fan duct.

An inner crank arm is linked in the preferred embodiment to a pivoted beam, the beam in turn linked to the individual unison rings, thus resulting in the adjustment of the stator vanes in response to the rotational movement of the torque shaft. The crank arm is keyed to the torque shaft which extends slidably through the spherical bearing supported by the fan duct. The torque shaft further includes an external crank arm outside the fan duct which is engaged with the drive rod of the actuator for selectively rotating the torque shaft.

The present invention thus provides a unitary link assembly between the linear actuator drive rod and the beam by accommodating any relative radial, circumferential, or axial movement between the compressor case and the fan duct in the support bearing arrangement. The disclosed linkage is thereby free from internal wear caused by sliding internal slip splines or other extensible connections. Moreover, the fewer intermediate moving parts provide a beneficial reduction in positional inaccuracy of the individual stator vanes.

It is therefore an object of the present invention to provide a mechanical control linkage between an internal moveable structure in a gas turbine engine and a drive actuator disposed external to such an engine.

It is further an object of the present invention that the provided linkage accommodate relative radial, circumferential, and axial displacement between the internal structure and the externally mounted actuator.

It is further an object that the accommodating linkage have a minimum of wearing parts and connections for achieving and maintaining a high accuracy of positional control between the external actuator and the internal structure.

It is still further an object that the provided linkage be operable for actuating a plurality of unison rings spaced axially along the compressor case of an axial flow turbofan gas turbine engine.

BRIEF DESCRIPTION OF THE DRAWINGS

FIG. 1 shows a schematic cross section of an axial flow turbofan gas turbine engine.

FIG. 4 shows a radially inward view of the exterior of a turbofan engine equipped with a linkage according to the present invention.

DETAILED DESCRIPTION OF THE PREFERRED EMBODIMENT

Figure 2:
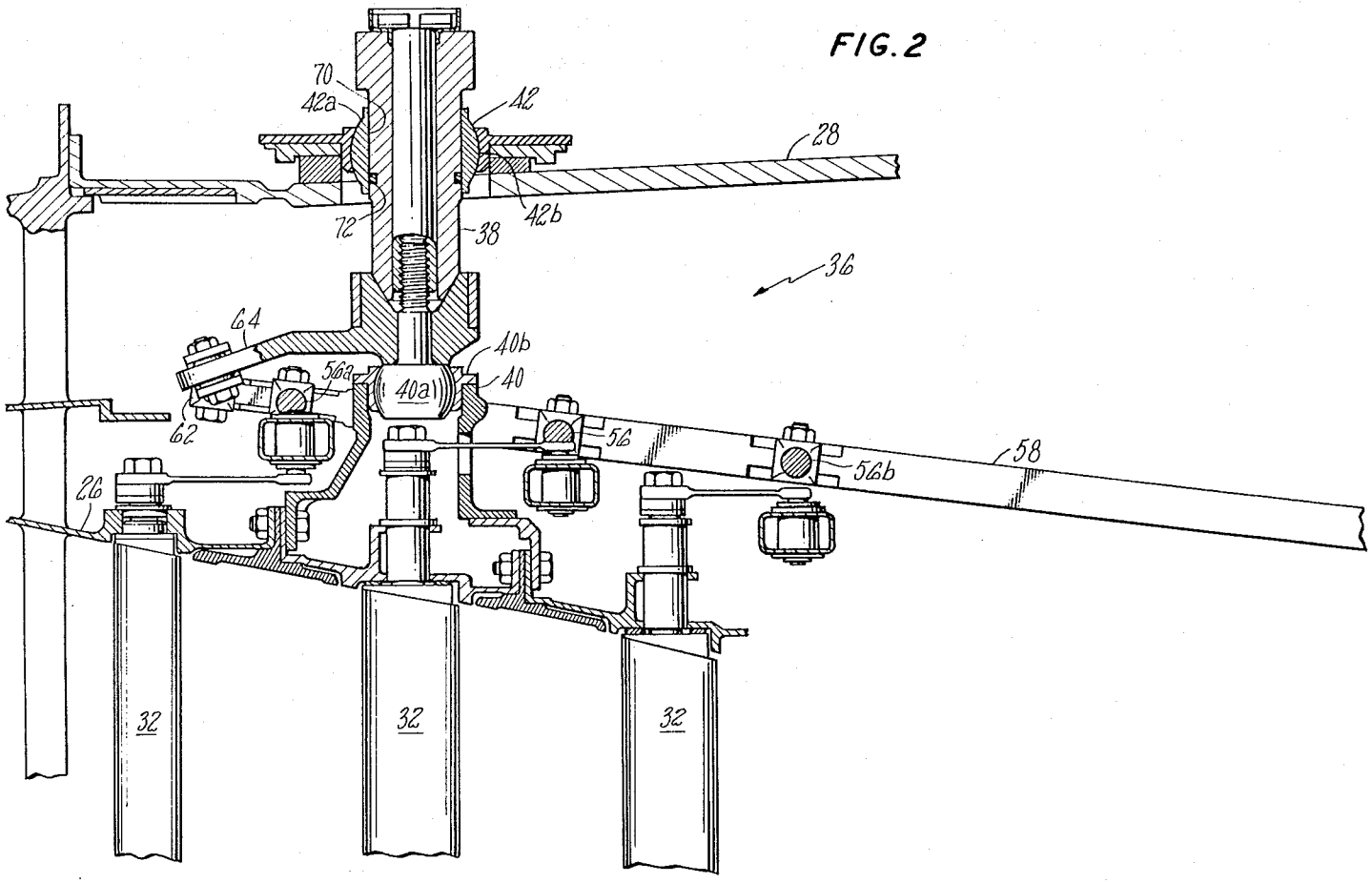
FIG. 2 shows a cross sectional view of the linkage according to the present invention taken in the plane of the engine central axis.

FIG. 1 shows a schematic cross sectional arrangement of a typical turbofan gas turbine engine 10 having an inlet 12 for admitting axially flowing air into a forward fan section 14. A portion of the air driven by the fan 14 enters the gas generator, or hot core, comprised of a compressor section 16, a diffuser section 18, a combustor section 20, and a turbine section 22. The air exiting the fan section 14 which does not enter the gas generator, termed "bypass air", flows axially rearward through an annular bypass air passage 24 formed between the exterior of the compressor case 26 and a surrounding, coaxial fan duct 28. The hot core gases exiting the turbine section 22 and the bypass air both exit the engine outlet nozzle 30 in the particular engine arrangement shown in FIG. 1.

As described hereinabove, it is frequently desirable to manipulate various engine components during operation in order to improve reliability and operability. An example of such components are the individual stator vanes 32 disposed in a series of axial stages within the compressor section 16. Such blades are disposed about the circumference of the axial compressor 16 and may be each rotated about their respective radially oriented axes to change the angle of attack of the axially flowing compressed air based on a variety of engine operating parameters such as compressor rotational speed, air temperature, overall air pressure, etc.

As is well known in the art, individual stages of stator vanes are rotated simultaneously by manipulation of a circular unison ring disposed about the circumference of the compressor case and linked to each individual stator vane by a corresponding vane arm.

Turbofan engines having high bypass air ratio configuration may mount the actuator for manipulating the stator vane unison rings on the compressor case within the bypass airflow passage 24. For low bypass ratio turbofan engines such as that shown in FIG. 1, the mounting of an actuator with its attendant bracing, etc., would not only severely disrupt the flow of bypass air in the narrow annular passage 24, but would also make the service and repair of such an actuator assembly extremely difficult. Such actuators 34 are thus commonly mounted on the exterior of the fan duct 28, linked to the unison rings by a mechanical linkage 36 as shown in the general arrangement of FIG. 1.

It will be appreciated by those skilled in the art that the manipulation of the individual stator vane unison rings must be highly accurate in order to derive the desired benefits of such adjustment. It will also be appreciated that the transient thermal conditions and other operating loads imposed on such engines during normal operation cause relative displacement between the compressor case 26 and fan duct 28 in the radial, circumferential, and/or axial directions. It is imperative that the linkage 36 disposed between the actuator 34 and the unison rings (not shown in FIG. 1) accommodate this relative movement without binding, wear, or introducing any positional inaccuracy between the actuator input and the manipulated rings.

As shown in FIG. 2, the present invention provides a generally radially oriented torque shaft 38 supported at the radially inward end by a first spherical bearing 40 secured to the compressor case 26, and a second universal bearing 42 secured to the fan duct 28. The universal bearings 40, 42 allow the solid shaft 38 to accommodate relative axial and circumferential movement between the duct 28 and the compressor case 26. Further, the second universal bearing 42 is adapted to slidably receive the torque shaft 38 therein, thus permitting relative radial displacement to occur.

The torque shaft 38 is thus free to rotate about its longitudinal axis as well as to be deflected within its supporting bearings 40, 42. Rotational motion is imparted to the torque shaft 38 by a laterally extending drive arm 44 shown more clearly in FIG. 4. Torque shaft 38 extends radially outward of the fan duct 28, at which point it is keyed or otherwise secured to the drive arm 44. In the preferred embodiment, drive arm 44 is pinned 46 to the linearly extensible drive shaft 48 of a drive actuator 34. The drive actuator 34 may be operable by hydraulic, pneumatic, electrical, or other means known in the art and is supportably secured to the fan duct 28.

The linear motion 52 of the actuator drive shaft 48 in response to a control influence causes the desired rotation of the torque shaft 38. It is a feature of the present invention that the torque shaft 38 provides rotational movement to the interior of the gas turbine engine 10 which is directly responsive to the drive shaft 48. There are no intervening links, joints, or other contrivances to accommodate the relative movement which occurs between the fan duct 28 and the compressor case 26. The rotational movement of the drive shaft 38 is thus a highly accurate and predictable reflection of the displacement of the drive shaft 48.

Figure 3:
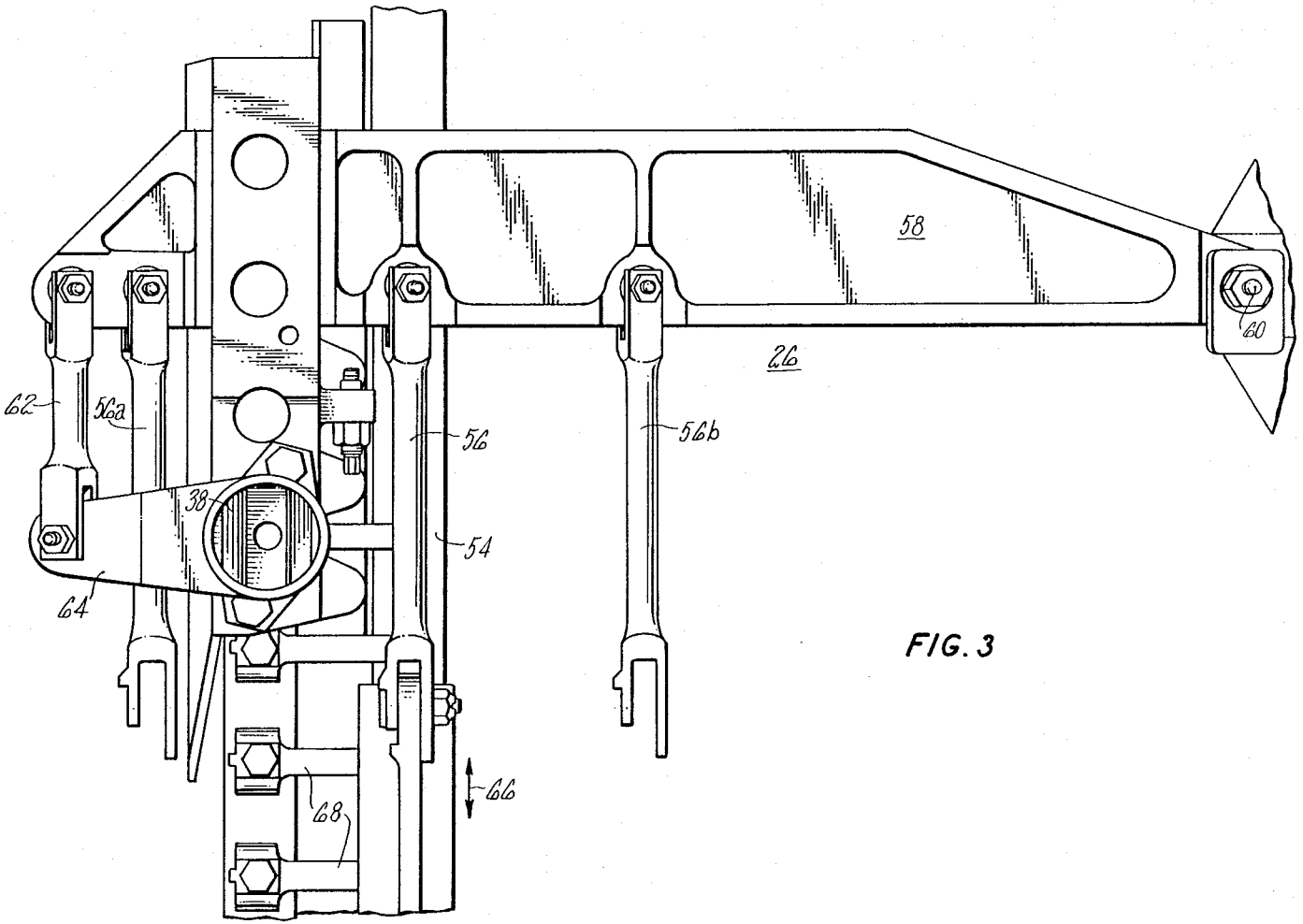
FIG. 3 shows a radially inwardly looking view of the linkage as indicated in FIG. 2.

The rotational motion of the torque shaft 38 moves an internal structure such as the unison ring 54 shown in FIG. 3 by a linking means comprising, in the preferred embodiment, a push rod 56 linking the unison ring 54 and a pivoted beam 58. The beam 58 is pivoted about an axis 60 radially oriented with respect to the generally cylindrical pressure case 26. The beam 58 is in turn linked to the torque shaft 38 by a drive link 62 disposed between the beam 58 and a laterally extending internal crank arm 64 secured to the torque shaft 38 intermediate the compressor case 26 and fan duct 28.

Rotational motion of the torque shaft 38 induced by the linear actuator 34 thus pivots the beam 58 driving the unison ring 54 via the ring link 56. The circumferential movement 66 of the unison ring 54 rotates the stator vanes 32 of an individual stator stage via the linking vane arms 68.

The preferred embodiment as shown in FIG. 3 is also well adapted to manipulate a plurality of unison rings by the addition of second and third ring links **56*a* and 56*b* between the beam 58 and corresponding unison rings (not shown). It will further be appreciated that the preferred embodiment utilizes simple pin joints between the links 56, 56*a*, 56*b*, 62** and the corresponding beam 58, arm 64 and unison rings 54. Such pin joints, subjected only to longitudinal compressive or tensile loading and experiencing only small rotational displacement during operation, provide a high tolerance, low wearing connection between the driving and driven components of the linkage according to the present invention.

The universal bearings 40, 42 in the preferred embodiment are close tolerance spherical bearings, each having an inner, ball portion 40*a*, 42*a* for forming a convex, toroidal outer surface, and an outer cup portion 40*b*, 42*b* having a corresponding inner surface engageable with at least a portion of the outer surface of the corresponding ball member 40*a*, 42*a*. Such spherical bearings, often permanently lubricated by a layer of tetrofluoroethylene or other material deposited on the ball and/or cup, allow free angular displacement and internal rotation of the torque shaft 38 while still supporting the shaft between the bearing assemblies 40, 42.

As stated above, the second bearing 42 secured to the fan duct 28 is adapted for receiving the torque shaft 38 slidable therethrough, thus permitting differential radial displacement between the fan duct 28 and the compressor case 26. Sealing of the sliding interface 70 is accomplished in the preferred embodiment by an annular gasket or O ring 72.

In summary, by translating and transferring the linear movement of the actuator shaft 48 mounted on the outer surface of the fan duct 28 into the interior of the engine 10 by a unitary, radially rotating torque shaft 38, and by accommodating any relative radial, circumferential, or axial movement between the fan duct 28 and the internal compressor case 26 in the shaft supporting bearings 40, 42, the linkage according to the present invention accurately and positively positions the unison ring 54 for achieving the desired stator vane angle of attack for the corresponding stator vane stage. Moreover, the absence of any sliding joints or other connections directly in the linkage eliminates the potential backlash and/or hysteresis attendant in such structures, particularly after extended service. The linkage according to the present invention, as described hereinabove with reference to the preferred embodiment and as limited solely by the appended claims, is thus seen as being well suited for achieving those objects set forth hereinabove.

We claim:

1. A linkage for imparting circumferential displacement to a stator vane unison ring disposed about a cylindrical compressor case of an axial flow gas turbine engine having an exterior, coaxial fan duct, comprising:

a unitary, elongated torque shaft extending radially from the compressor case through the fan duct;

a first universal bearing disposed between the torque shaft and the compressor case;

a second universal bearing disposed between the fan duct and the torque shaft, including means, slidably receiving the torque shaft therein, for permitting longitudinal displacement between the torque shaft and the second bearing;

an internal crank arm, extending laterally from the torque shaft intermediate the first and second universal bearings;

a beam, pivotably secured to the compressor case at a pivot point spaced axially from both the unison ring and the second universal bearing;

a drive link, disposed between the internal crank arm and the beam for pivoting the beam in response to rotation of the torque shaft;

a ring link, extending between the unison ring and the beam and spaced axially from the beam pivot point for driving the unison ring circumferentially in response to the pivoting of the beam; and means, disposed radially outward of the fan duct, for selectably rotating the torque shaft about the longitudinal axis thereof.

2. The linkage as recited in claim 1, wherein the means for selectably rotating the torque shaft about the longitudinal axis thereof further comprises an external crank arm, extending laterally from the torque shaft at a point radially outward of the fan duct, and a linear actuator, engaged with the external crank arm, for selectably inducing the rotation of the torque shaft via the external crank arm.

* * * * *